US007726848B2

(12) United States Patent
Lai

(10) Patent No.: US 7,726,848 B2
(45) Date of Patent: Jun. 1, 2010

(54) SOLID-STATE ILLUMINATING APPARATUS

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 208 days.

(21) Appl. No.: 11/967,127

(22) Filed: Dec. 29, 2007

(65) Prior Publication Data

US 2009/0147525 A1 Jun. 11, 2009

(51) Int. Cl.
*F21V 7/00* (2006.01)

(52) U.S. Cl. ..... 362/300; 362/298

(58) Field of Classification Search ..... 362/297, 362/298, 299, 300, 301, 310
See application file for complete search history.

(56) References Cited

U.S. PATENT DOCUMENTS 4,587,601 A 5/1986 Collins
4,920,469 A * 4/1990 Harding ..... 362/300
5,582,480 A 12/1996 Zwick et al.
6,132,067 A 10/2000 Scholz
6,598,998 B2 7/2003 West et al.
7,458,703 B2 * 12/2008 Han et al. ..... 362/267

FOREIGN PATENT DOCUMENTS

CN 1437693 A 8/2003
EP 0509679 A2 10/1992
JP 2000-315406 A 11/2000
JP 2001-076511 A 3/2001
JP 2007-299599 A 11/2007

* cited by examiner

*Primary Examiner*—John A Ward
(74) *Attorney, Agent, or Firm*—Jeffrey T. Knapp

(57) ABSTRACT

A solid-state illuminating apparatus (10) includes a first light reflector (11), a second light reflector (12), an annular light permeable cover (15) and a light source (13). The first light reflector has a bottom wall (111) and a peripheral sidewall (112) extending from and surrounding the bottom wall. The first light reflector has a reflective surface (113) formed on an inner surface thereof. The second light reflector has a reflective surface (121) facing toward the bottom wall. The light permeable cover is interconnected between a periphery of the sidewall and a periphery of the second light reflector. The first light reflector, the light permeable cover and the second light reflector cooperatively form a chamber (114). The chamber tapers along a direction from the second light reflector to the bottom wall. The light source is received in the chamber and located on the bottom wall.

20 Claims, 12 Drawing Sheets

SOLID-STATE ILLUMINATING APPARATUS

BACKGROUND

1. Technical Field

The present invention relates generally to illuminating apparatuses, and particularly to a solid-state illuminating apparatus having an annular light exiting surface and improved energy efficiency thereof.

2. Description of Related Art

Presently, an annular solid-state illuminating apparatus generally includes a annular fluorescent lamp and a lamp cover for adjusting brightness of the fluorescent lamp. It is well known that the fluorescent lamp has many disadvantages, such as higher energy consumption, bulky volume, short service lifetime, start-up retardance and so on. Furthermore, a stabilizer is required for stabilizing an output of the annular fluorescent lamp.

With the continuing development of scientific technology, light emitting diodes (LEDs) have been widely used in the illumination field to substitute for the conventional fluorescent lamp due to their high brightness, long service lifetime, and wide color gamut. Relevant subject is disclosed in an article entitled "Solid-State Lighting: Toward Superior Illumination", published in a magazine *Proceedings of the IEEE*, Vol. 93, No. 10, by Michael S. Shur et al. in October, 2005, the disclosure of which is incorporated herein by reference.

However, in a particular solid-state illuminating apparatus, it is important to assemble the light emitting components (such as the LEDs) with other components of the solid-state illuminating apparatus for further improving the energy saving efficiency thereof.

What is needed, therefore, is a solid-state illuminating apparatus having an annular light exiting surface, which can overcome the above-mentioned disadvantages.

SUMMARY

The present invention relates to a solid-state illuminating apparatus. According to a preferred embodiment of the present invention, the solid-state illuminating apparatus includes a first light reflector, a second light reflector, an annular light permeable cover and a light source. The first light reflector has a bottom wall and a peripheral sidewall extending from and surrounding the bottom wall. The first light reflector has a reflective surface formed on an inner surface thereof. The second light reflector has a reflective surface facing toward the bottom wall. The light permeable cover is interconnected between a periphery of the sidewall and a periphery of the second light reflector. The first light reflector, the light permeable cover and the second light reflector cooperatively form a chamber. The chamber tapers along a direction from the second light reflector to the bottom wall. The light source is received in the chamber and located on the bottom wall.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
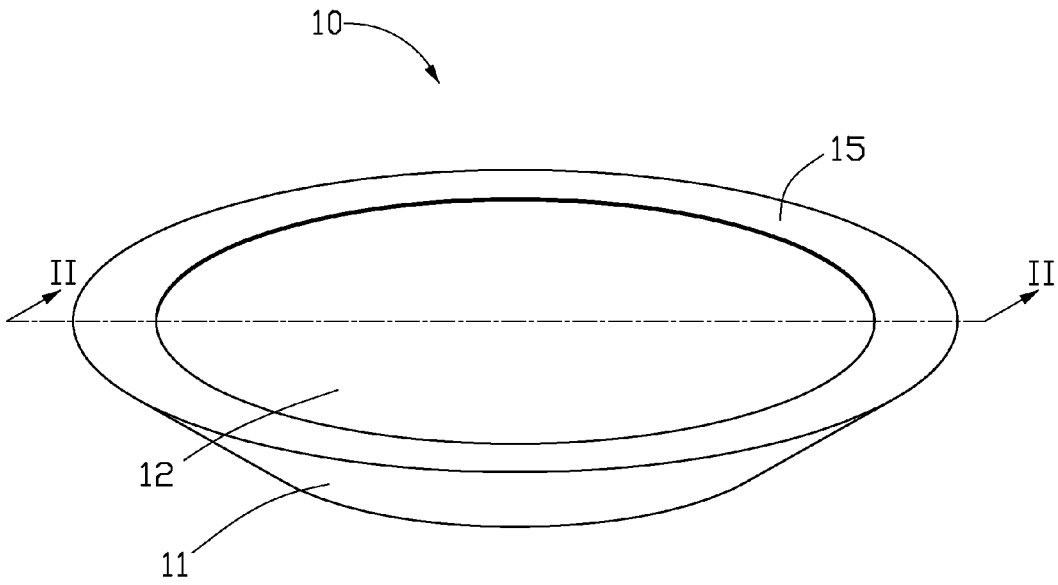
FIG. 1 is an assembled, isometric view of a solid-state illuminating apparatus in accordance with a first preferred embodiment of the present invention.
Figure 2:
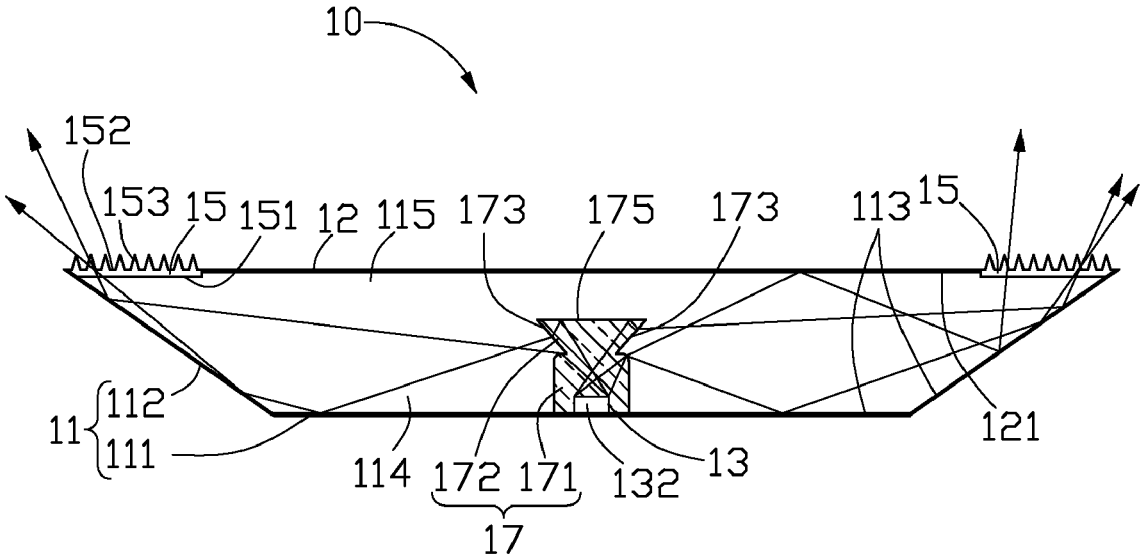
FIG. 2 is a cross-sectional view of the solid-state illuminating apparatus of FIG. 1, taken along line II-II thereof.

Referring to FIGS. 1 and 2, a solid-state illuminating apparatus 10 in accordance with a first preferred embodiment of the present invention includes a first light reflector 11, a second light reflector 12, a light source 13 and a light permeable cover 15.

The first light reflector 11 has a bowl shape and defines an opening 115 at a top thereof. The first light reflector 11 includes a bottom wall 111 and a peripheral sidewall 112 extending from and surrounding the bottom wall 111. The first light reflector 11 has a reflective surface 113 formed on an inner surface thereof so as to reflect the light emitted from the light source 13.

The second light reflector 12 has a disk shape and is positioned at a central position of the opening 115 of the first light reflector 11. A diameter of the second light reflector 12 is less than that of the opening 115 of the first light reflector 11. The second light reflector 12 has a reflective surface 121 facing toward the bottom wall 111 so as to reflect the light emitted from the light source 13.

The light permeable cover 15 is annular and is positioned at the opening 115 of the first light reflector 11 interconnected between a periphery of the sidewall 112 of the second light reflector 11 and a periphery of the second light reflector 12. The light permeable cover 15, the first light reflector 11 and the second light reflector 12 cooperatively form a chamber 114. The chamber 114 tapers along a direction from the second reflector 12 to the bottom wall 111 of the first light reflector 11. The light permeable cover 15 is made of light penetrable materials such as silicone, resin, glass, polymethyl methacrylate (PMMA), quartz and so on. The light permeable cover 15 has a bottom light input surface 151 facing the chamber 114 of the first light reflector 11 and a top light output surface 152 opposite to the light input surface 151. A plurality of protrusions 153 is formed on the light output surface 152. In this embodiment, the protrusions 153 have a triangular cross section. When passing through the light permeable cover 15, the light emitted from the light source 13 can be evenly deflected by the protrusions 153 on the light output surface 152 of the light permeable cover 15. Consequently, a soft light that will be glareless emits from the light output surface 152.

The light source 13 is received in the chamber 114 of the first light reflector 11 and is located on the bottom wall 111 at a center thereof for confronting the second light reflector 12. The light source 13 includes a light emitting component 132, such as an LED. A light director 17 is covered on an outer periphery of the light emitting component 132. The light director 17 is a lens, and includes a lower portion 171 enclosing the light emitting component 132 therein and an upper portion 172 disposed above the lower portion 171. The upper portion 172 includes a planar top reflective surface 175 for reflecting the light emitted from the light emitting component 132 and a slanted transmissive side surface 173 for transmitting the light emitted from the light emitting component 132. The transmissive side surface 173 is annular and engages with an outer periphery of the top reflective surface 175. The upper portion 172 tapers along a direction from the top reflective surface 175 to the lower portion 171. As described in more details below, the light director 17 changes the direction of the light emitted from the light emitting component 132.

When the present solid-state illuminating apparatus 10 operates, the light emitting component 132 received in the chamber 114 emits light. A portion of the light is refracted through the lower portion 171 of the light director 17, changes its original direction, and then strikes on the reflective surface 113 of the first light reflector 11 and the reflective surface 121 of the second light reflector 12. Another portion of the light passes through the lower portion 171 to the top reflective surface 175 and the transmissive side surfaces 173 of the upper portion 172 of the light director 17. The light arrived at the transmissive side surfaces 173 is refracted through the transmissive side surfaces 173 and then strikes on the reflective surface 113 of the first light reflector 11 and/or the reflective surface 121 of the second light reflector 12. The light arrived at the top reflective surface 175 is reflected back towards the transmissive side surfaces 173, and then refracted through the transmissive side surfaces 173 to strike on the reflective surface 113 of the first light reflector 11 and/or the reflective surface 121 of the second light reflector 12. The light arrived at the reflective surface 113 of the first light reflector 11 and the reflective surface 121 of the second light reflector 12 is reflected in different directions to finally arrive at the light input surface 151 of the light permeable cover 15, and then exits from the light output surface 152 of the light permeable cover 15 into an outside of the solid-state illuminating apparatus 10 for illumination purposes. The light output surface 152 of the annular light permeable cover 15 functions as an annular light exiting surface for the solid-state illuminating apparatus 10.

In the present solid-state illuminating apparatus 10, the first light reflector 11, the second light reflector 12 and the light director 17 are provided to cooperate with each other to reflect the light emitted from the light emitting component 132 of the light source 13 and enable the reflected light to finally exit the illuminating apparatus 10 through the light permeable cover 15, whereby the light emitted from the light emitting component 132 can be reflected and/or refracted via the light director 17, reflected via the first light reflector 11 and the second light reflector 12 successively, and then passes through the light permeable cover 15 into an outside of the solid-state illuminating apparatus 10, thus preventing the light from being absorbed as much as possible in the illuminating apparatus 10, decreasing the wastage of the light and accordingly improving energy saving efficiency of the solid-state illuminating apparatus 10.

Figure 3:
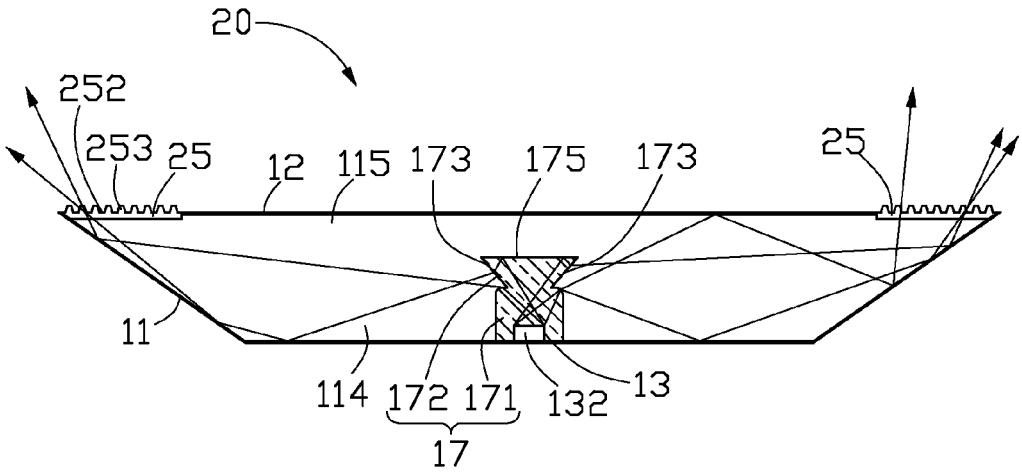
FIG. 3 is a cross-sectional view of a solid-state illuminating apparatus in accordance with a second preferred embodiment of the present invention.

Alternatively, the protrusions 153 on the on the light output surface 152 of the light permeable cover 15 can be other shapes. Referring to the FIG. 3, a solid-state illuminating apparatus 20 in accordance with a second preferred embodiment of the present invention is shown. In this embodiment, the protrusions 253 on the light output surface 252 of the light permeable cover 25 have a rectangular cross section.

Figure 4:
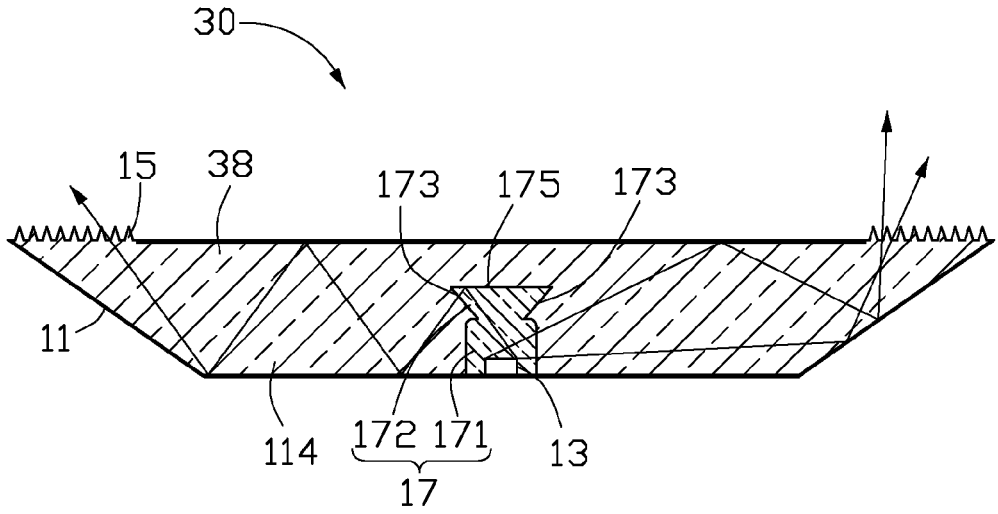
FIG. 4 is a cross-sectional view of a solid-state illuminating apparatus in accordance with a third preferred embodiment of the present invention.

Referring to FIG. 4, a solid-state illuminating apparatus 30 in accordance with a third preferred embodiment of the present invention is shown. In this embodiment, a filling material 38 is provided to fill the chamber 114 of the first light reflector 11. The filling material 38 includes light penetrating materials such as silicone, resin, glass, polymethyl methacrylate, quartz and so on. A refractive index of the filling material 38 substantially equals to that of the light permeable cover 15 and the light director 17. The filling material 38 functions to exhaust interior air out of the illuminating apparatus 30, thereby decreasing the wastage of the light emitted from the light emitting component 132.

Alternatively, the light source 13 in the solid-state illuminating apparatus 10, 20, 30 can also have other configurations, as shown in the following embodiments.

Figure 5:
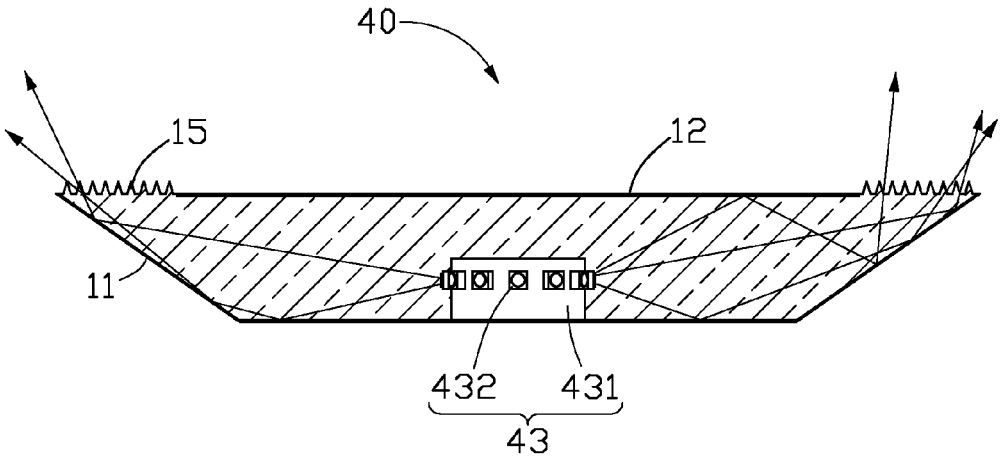
FIG. 5 is a cross-sectional view of a solid-state illuminating apparatus in accordance with a fourth preferred embodiment of the present invention.
Figure 6:
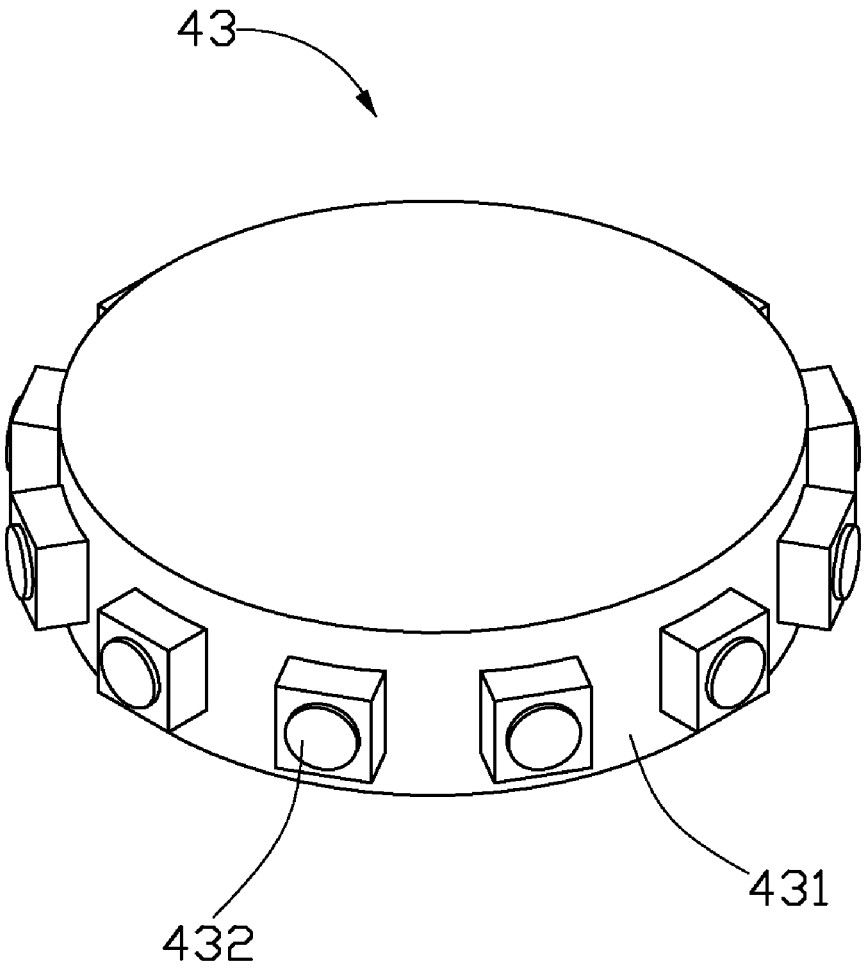
FIG. 6 is an enlarged view of a light source of the solid-state illuminating apparatus of FIG. 5.

FIGS. 5 and 6 illustrate a solid-state illuminating apparatus 40 in accordance with a fourth preferred embodiment of the present invention. In this embodiment, there is no light director 17. The light source 43 includes a cylindrical base 431 and a plurality of light emitting components 432 engaged with a circumferential surface of the base 431 so as to form a radial side light source, whereby the light emitting components 432 can emit light from the circumferential surface of the base 431. The light emitted from the light emitting components 432 strikes directly from the circumferential surface of the base 431 on the inner surface of the first light reflector 11 and the bottom surface of the second light reflector 12, and then passes through the light permeable cover 15 into an outside of the solid-state illuminating apparatus 40. In addition, the plurality of light emitting components 432 can improve brightness of the solid-state illuminating apparatus 40 comparing with the single light emitting component 132 in the solid-state illuminating apparatus 10, 20, 30.

Figure 7:
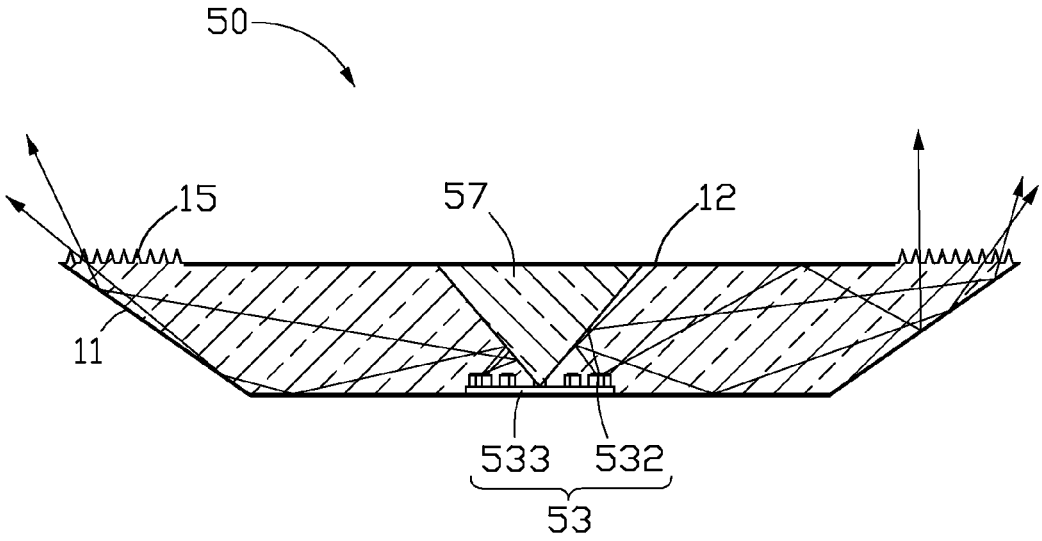
FIG. 7 is a cross-sectional view of a solid-state illuminating apparatus in accordance with a fifth preferred embodiment of the present invention.
Figure 8:
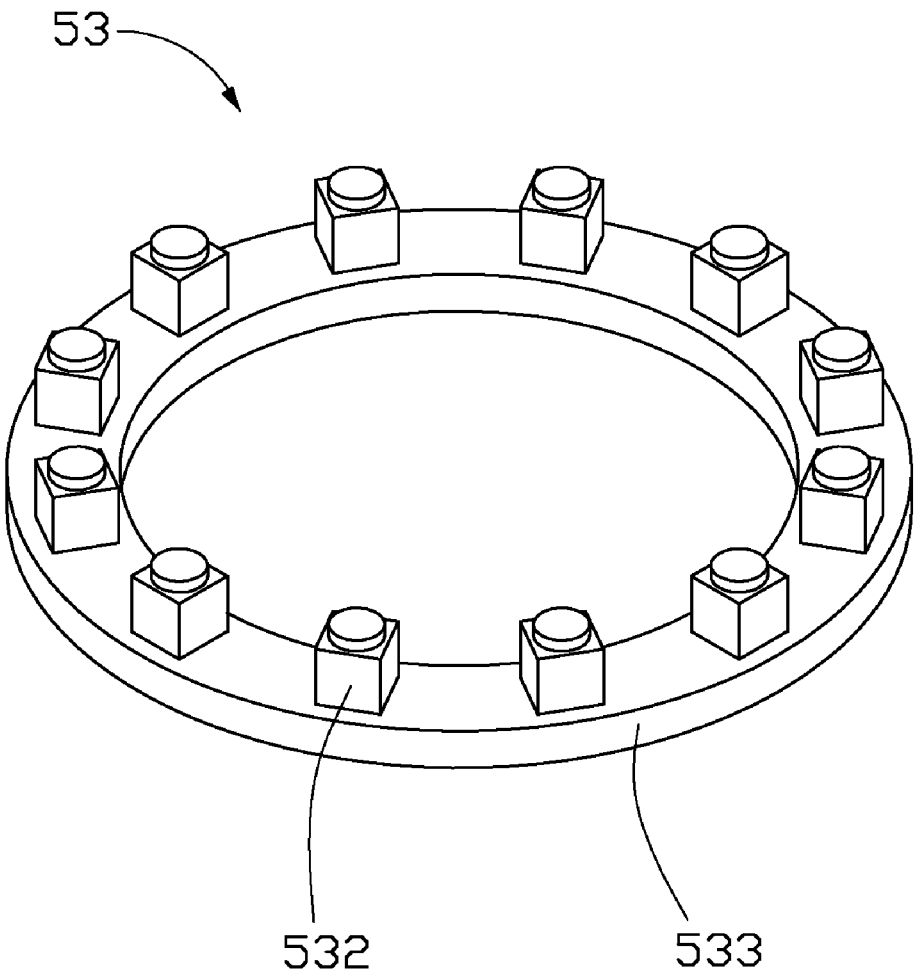
FIG. 8 is an enlarged view of a light source of the solid-state illuminating apparatus of FIG. 7.

Referring to FIGS. 7 and 8, a solid-state illuminating apparatus 50 in accordance with a fifth preferred embodiment of the present invention is shown. The light source 53 includes an annular base 533 and a plurality of light emitting components 532 evenly distributed on the base 533. The light director 57 has an inverted conical shape, with a conical tip thereof located at the center of the annular base 533 and a planar top reflective surface abutting on the bottom surface of the second light reflector 12. An outer conical circumferential surface of the light director 57 is a reflecting surface for changing a direction of the light emitted from the light emitting components 532. Alternatively, the light director 57 can be a lens, with the planar top reflective surface thereof being a reflecting surface and the outer conical circumferential surface being a light penetrating surface, whereby the transferring path of the light will be approximately the same as that of the solid-state illuminating apparatus 10 in the first preferred embodiment.

Figure 9:
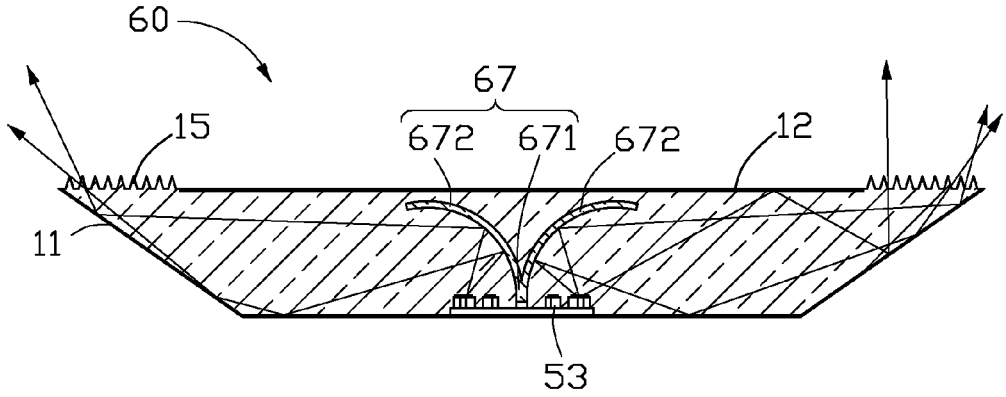
FIG. 9 is a cross-sectional view of a solid-state illuminating apparatus in accordance with a sixth preferred embodiment of the present invention.

FIG. 9 illustrates a solid-state illuminating apparatus 60 in accordance with a sixth preferred embodiment of the present invention. In this embodiment, the light director 67 includes a fixed portion 671 located proximate to the center of the light source 53 and an arc-shaped reflective surface 672 generated by a curved line passing through the fixed portion 671 and moving along a fixed circle. Other structures of the solid-state illuminating apparatus 60 of this embodiment are the same as those of the solid-state illuminating apparatus 50 of the previous embodiment.

Figure 10:
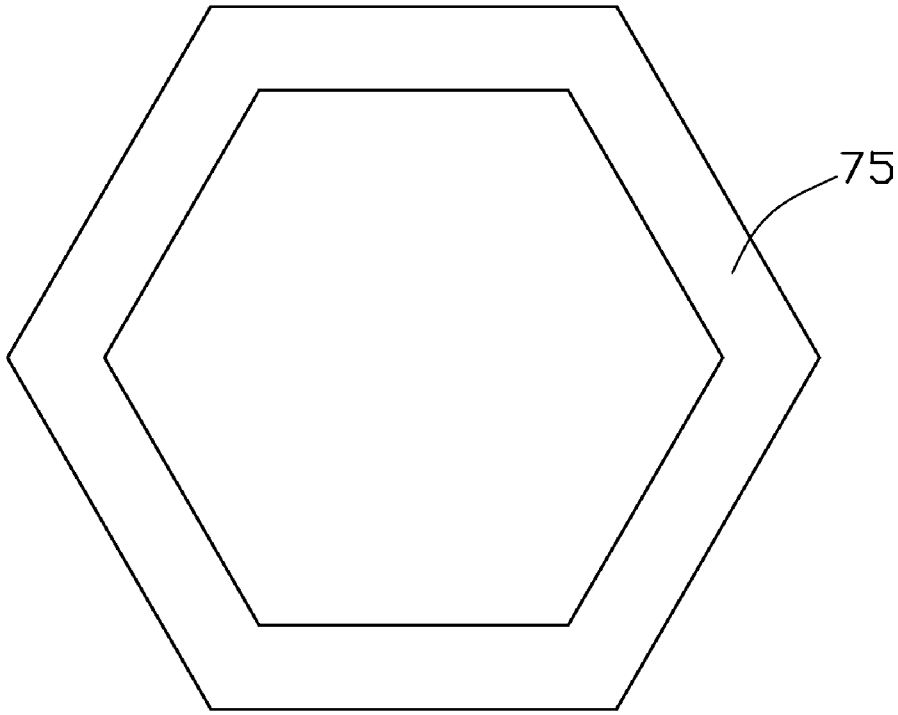
FIG. 10 is a schematic plan view of a light permeable cover of a solid-state illuminating apparatus in accordance with a seventh preferred embodiment of the present invention.
Figure 11:
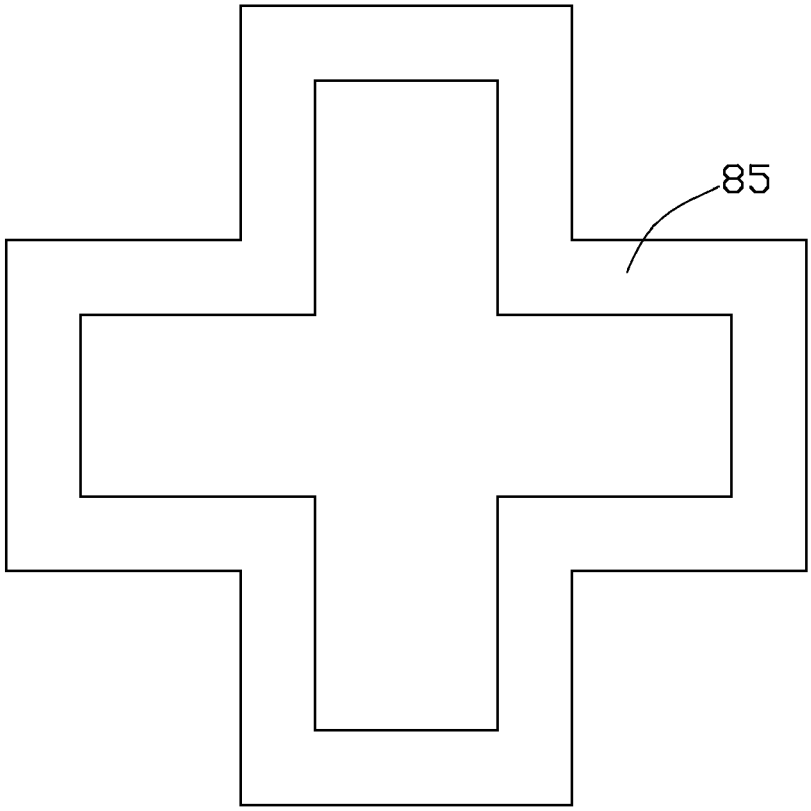
FIG. 11 is a schematic plan view of a light permeable cover of a solid-state illuminating apparatus in accordance with an eighth preferred embodiment of the present invention.
Figure 12:
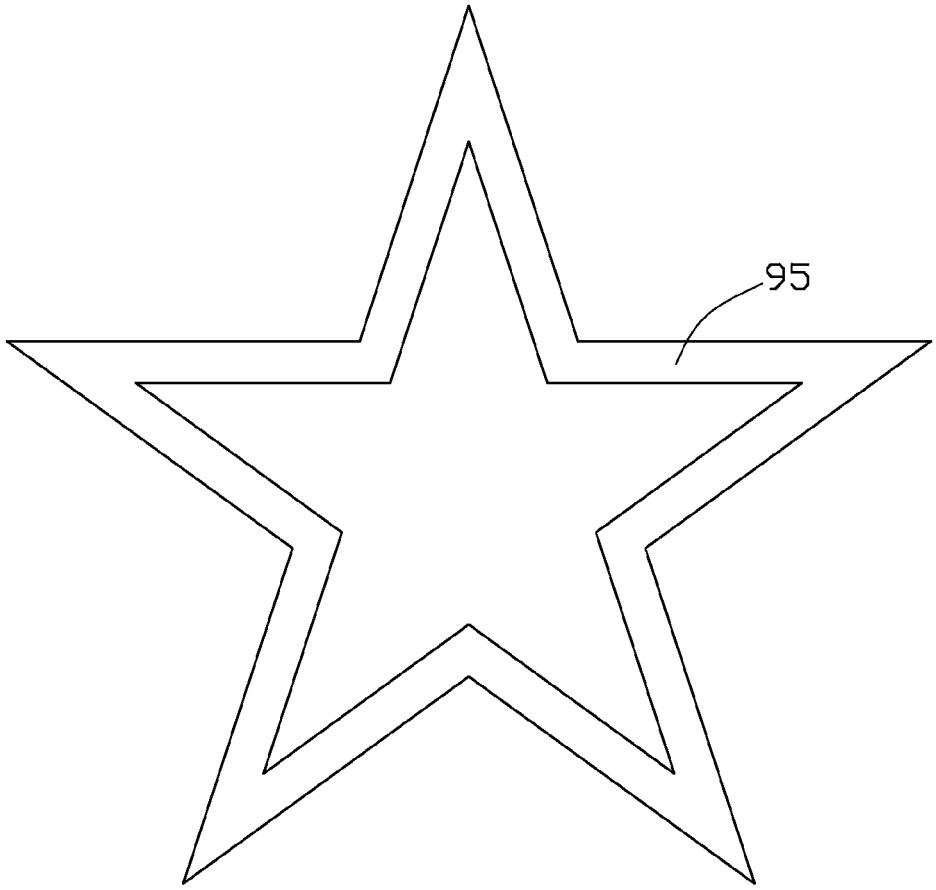
FIG. 12 is a schematic plan view of a light permeable cover of a solid-state illuminating apparatus in accordance with a ninth preferred embodiment of the present invention.

In addition, the annular light permeable cover 15, 25 in the solid-state illuminating apparatus 10, 20, 30, 40, 50, 60 are not limited by their circular shapes. As shown in FIG. 10, the annular light permeable cover 75 has a polygonal shape; as shown in FIG. 11, the annular light permeable cover 85 has a cross-shaped profile; as shown in FIG. 12, the annular light permeable cover 95 has a star-shaped profile. In order to fit the different shapes of the light permeable cover 75, 85, 95, the first and second light reflectors 11, 12 in the above-described solid-state illuminating apparatus 10, 20, 30, 40, 50, 60 should also be accordingly changed.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A solid-state illuminating apparatus comprising:

a first light reflector having a bottom wall and a peripheral sidewall extending from and surrounding the bottom wall, the first light reflector having a reflective surface formed on an inner surface thereof;

a second light reflector having a reflective surface facing toward the bottom wall of the first light reflector;

an annular light permeable cover interconnected between a periphery of the sidewall of the first light reflector and a periphery of the second light reflector, the first light reflector, the light permeable cover and the second light reflector cooperatively forming a chamber, the chamber tapering along a direction from the second light reflector to the bottom wall of the first light reflector, the annular light permeable cover comprising a plurality of protrusions formed on an output surface of the light permeable cover; and a light source received in the chamber and located on the bottom wall of the first light reflector.

2. The solid-state illuminating apparatus as claimed in claim 1, wherein the light permeable cover is comprised of silicone, resin, glass, polymethyl methacrylate or quartz.

3. The solid-state illuminating apparatus as claimed in claim 1, wherein the annular light permeable cover has a circular, polygonal, cross-shaped or star-shaped profile.

4. The solid-state illuminating apparatus as claimed in claim 1, wherein the protrusions have a triangular or a rectangular cross section.

5. The solid-state illuminating apparatus as claimed in claim 1, further comprising a light penetrable material filled in the chamber.

6. The solid-state illuminating apparatus as claimed in claim 5, wherein a refractive index of the light penetrating material substantially equals to a refractive index of the light permeable cover.

7. The solid-state illuminating apparatus as claimed in claim 1, wherein the light source comprises a point light source for emitting light toward the second light reflector and a light director, the light director being received in the chamber and configured for directing the light emitted from the point light source to emit toward the first light reflector.

8. The solid-state illuminating apparatus as claimed in claim 7, wherein the light director includes a lower portion enclosing the point light source therein and an upper portion disposed above the lower portion, the upper portion having a planar top reflective surface for reflecting the light emitted from the point light source and a slanted transmissive side surface, the upper portion tapering along a direction from the planar top reflective surface to the lower portion.

9. The solid-state illuminating apparatus as claimed in claim 7, wherein the light source comprises a base and a plurality of light emitting components arranged in a circle on the base, the light director being located at a center of the base.

10. The solid-state illuminating apparatus as claimed in claim 9, wherein the light director has an inverted conical shape, a conical tip thereof being located at the center of the base, an outer conical circumferential surface thereof being a reflecting surface.

11. The solid-state illuminating apparatus as claimed in claim 9, wherein the light director is an inverted conical lens, a top surface of the light director being a reflecting surface and an outer conical circumferential surface thereof being a light penetrating surface.

12. The solid-state illuminating apparatus as claimed in claim 9, wherein the light director comprises a reflective surface generated by a curved line passing through a fixed point and moving along a fixed circle, the fixed point located proximate to the center of the circle on the base, the reflective surface being configured for reflecting the light emitted from the light emitting components.

13. The solid-state illuminating apparatus as claimed in claim 1, wherein the light source comprises a cylindrical base and a plurality of light emitting components engaged with a circumferential surface of the cylindrical base.

14. A solid-state illuminating apparatus comprising:

a first light reflector defining a chamber therein and an opening at a top thereof;

a second light reflector located at a central position of the opening of the first light reflector;

a closed light permeable cover located at the opening of the first light reflector and surrounding the second light reflector for sealing the chamber of the first light reflector; and a light source received in the chamber of the first light reflector, wherein the light source comprises a point light source for emitting light toward the second light reflector and a light director, the light director being received in the chamber and configured for directing the light emitted from the point light source to emit toward the first light reflector.

15. The solid-state illuminating apparatus as claimed in claim 14, wherein the light permeable cover has a circular, polygonal, cross-shaped or star-shaped profile.

16. The solid-state illuminating apparatus as claimed in claim 14, further comprising a light penetrable material filled in the chamber, a refractive index of the light penetrating material substantially equaling to a refractive index of the light permeable cover.

17. The solid-state illuminating apparatus as claimed in claim 14, wherein the light director includes a lower portion enclosing the point light source therein and an upper portion disposed above the lower portion, the upper portion having a planar top reflective surface for reflecting the light emitted from the point light source and a slanted transmissive side surface, the upper portion tapering along a direction from the planar top reflective surface to the lower portion.

18. The solid-state illuminating apparatus as claimed in claim 14, wherein the light source comprises a base and a plurality of light emitting components arranged in a circle on the base, the light director being located at a center of the base.

19. A solid-state illuminating apparatus comprising:

a first light reflector having a bottom wall and a peripheral sidewall extending from and surrounding the bottom wall, the first light reflector having a reflective surface formed on an inner surface thereof;

a second light reflector having a reflective surface facing toward the bottom wall of the first light reflector;

an annular light permeable cover interconnected between a periphery of the sidewall of the first light reflector and a periphery of the second light reflector, the first light reflector, the light permeable cover and the second light reflector cooperatively forming a chamber, the chamber tapering along a direction from the second light reflector to the bottom wall of the first light reflector; and a light source received in the chamber and located on the bottom wall of the first light reflector;

wherein the light source comprises a point light source for emitting light toward the second light reflector and a light director, the light director being received in the chamber and configured for directing the light emitted from the point light source to emit toward the first light reflector.

20. The solid-state illuminating apparatus as claimed in claim 19, wherein the light director includes a lower portion enclosing the point light source therein and an upper portion disposed above the lower portion, the upper portion having a planar top reflective surface for reflecting the light emitted from the point light source and a slanted transmissive side surface, the upper portion tapering along a direction from the planar top reflective surface to the lower portion.

* * * * *